United States Patent [19]

Constantinescu

[11] 4,167,365

[45] Sep. 11, 1979

[54] CAR PARKING SYSTEM

[76] Inventor: Spiridon Constantinescu, 161 Violet Dr., Stoney Creek, Ontario, Canada

[21] Appl. No.: 826,918

[22] Filed: Aug. 22, 1977

[51] Int. Cl.[2] ..... E04H 6/22; E04H 6/24

[52] U.S. Cl. ..... 414/239; 414/264; 187/8.56

[58] Field of Search ..... 214/16.1 CC, 16.1 CE, 214/16.1 EB; 187/8.56, 19

[56] References Cited

U.S. PATENT DOCUMENTS

| | | | |
|---|---|---|---|
| 1,874,859 | 8/1932 | Been | 214/16.1 CE |
| 2,579,688 | 12/1951 | McCormick | 214/16.1 EC X |
| 3,499,553 | 3/1970 | Stienen | 214/16.1 CE |

*Primary Examiner*—Robert G. Sheridan

[57] ABSTRACT

A parking system for cars has a plurality of parking shelves disposed horizontally and vertically on both sides of a central zone of vertical movement, one car being carried to and from the shelf by a carrier activated by its driving gear means to raise on vertical racks in the central zone and to perform its lateral movement in the parking shelf at its parking level where a series of rams make the racks discontinuous and from the shelves, on both sides, extensible rails extend their mobile parts beneath the carrier when it is arrived at its parking level; the driving means of the carrier being: the car itself, a motor of the carrier, or the car for the loaded carrier and the carrier's motor for the unloaded carrier; the unloaded carrier being stored either in a central basement or in parking shelves.

6 Claims, 29 Drawing Figures

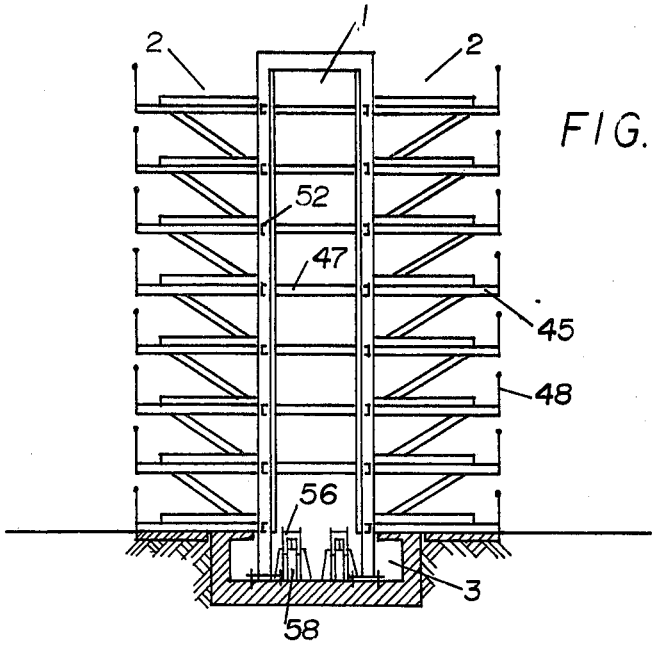
FIG. 22
FIG. 23
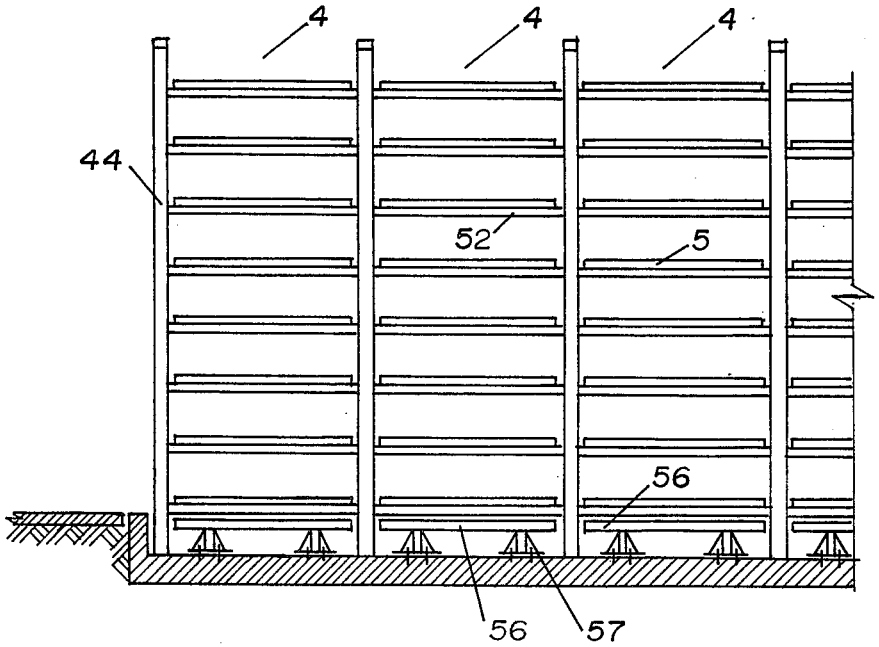

CAR PARKING SYSTEM

The present invention relates to a parking system for cars, in which carriers are provided in a spatial structure for carrying the cars to and from the parking shelves which are in a honycomb arrangement, the driving means being the propelling wheels of the car or a motor of the carrier.

It is known that car parking in the metropolises is an unsatisfactorily solved problem at present. Land is extremely expensive and mainly assigned to buildings and roads, as that parking for the endless converging of cars is very expensive in the few existing parking lots which are irrationally used. As a matter of fact, many inconveniences give people a lot of difficulty in their attempts to reach and to make use of "piled up" urban centres.

I have found that these disadvantages may be overcome by providing honeycomb structures whose cells are like shelves in which the drawers are automotive platforms bearing the parking cars. The automotive platforms are carriers raising vertically by means of pinions meshing with vertical racks and sliding horizontally on extensible rails extended beneath them. Such structure, as a unit, performs the maximum possible density of parking reported on a used lot, and identical structures juxtaposed and superimposed allow the erection of high blocks provided with a plurality of entrances and exits and a plurality of high speed elevators between units so that the difficult problem of parking in the metropolises could find the best solution by the multitude of parked cars and by the rapid movement of such an organized system.

The invention will be more clearly understood after reference to the following detailed specification read in conjunction with the drawings wherein:

FIG. 22 is a cross section through the structure and its mobile track in the basement when the unloaded carriers rest in their shelves.

FIG. 23 is a longitudinal section through the structure and its mobile track in the basement when the unloaded carriers rest in their shelves.

Figure 1:
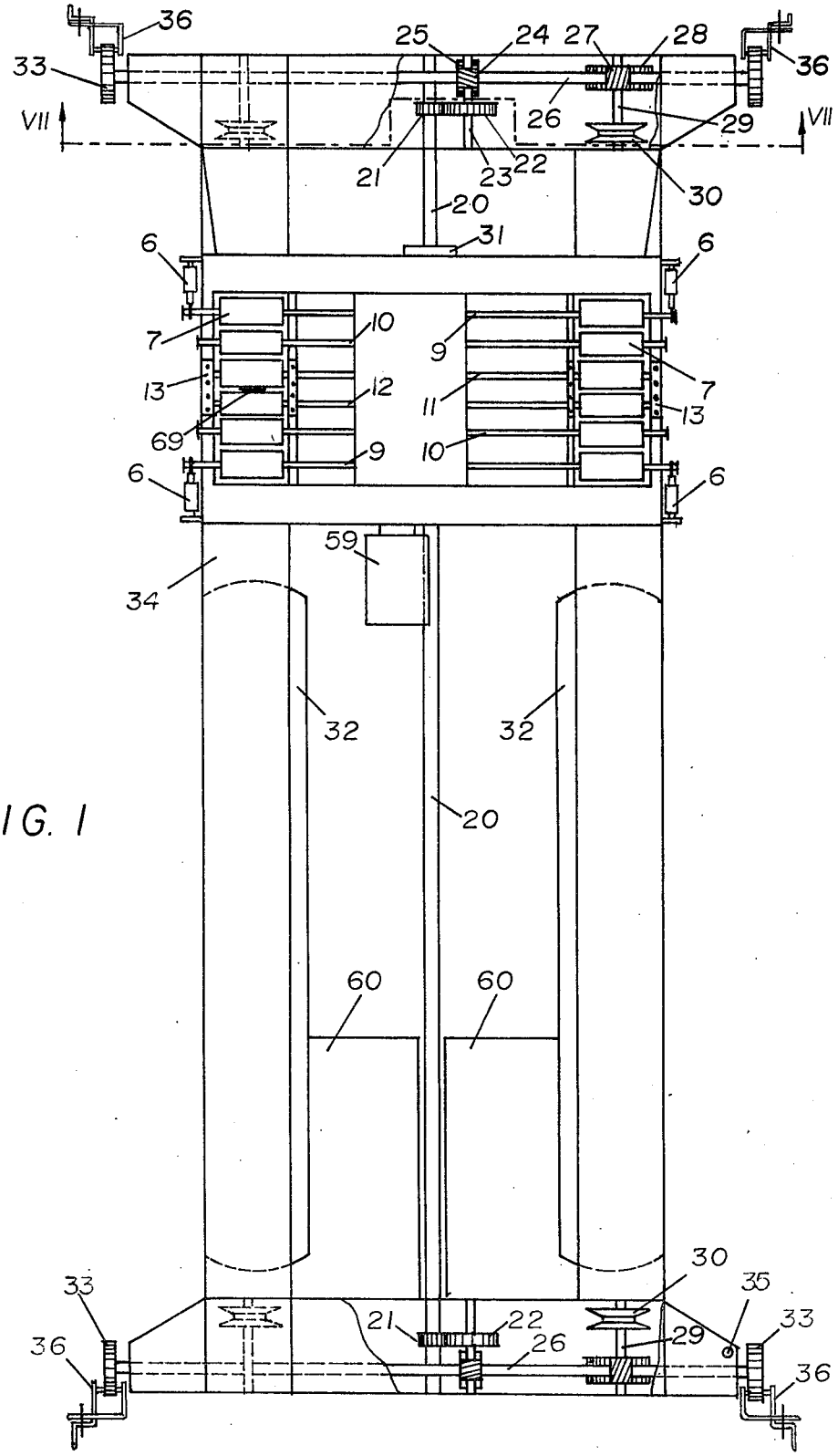
FIG. 1 is a top plan view of a carrier.
Figure 2:
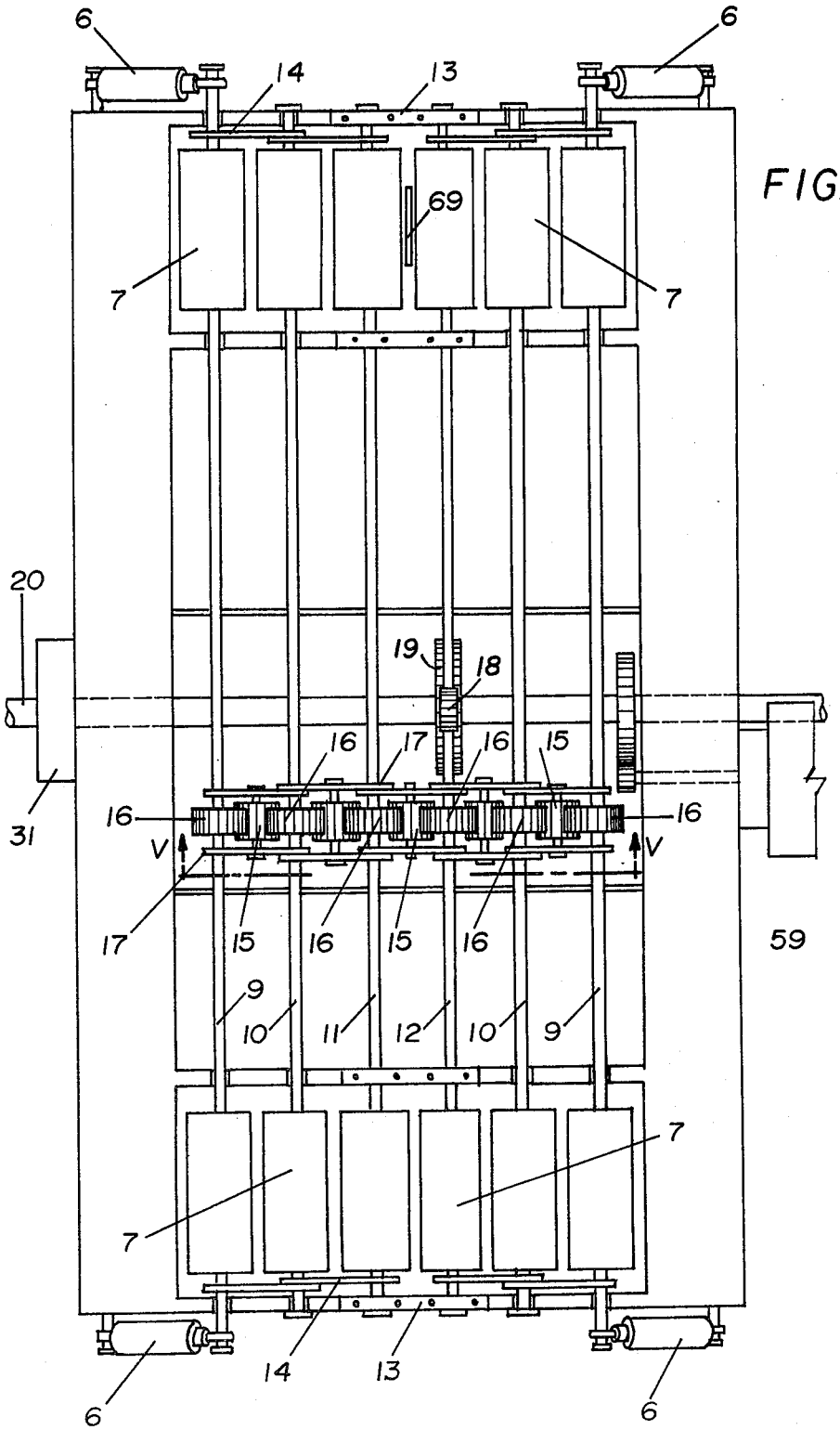
FIG. 2 is a top plan view of a part of a carrier with the friction coated rollers and its driving gear means.
Figure 3:
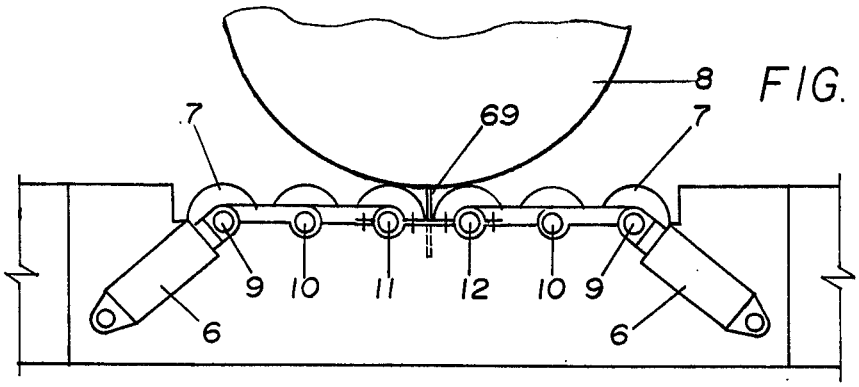
FIG. 3 is an elevation of the tire coupling device and its retracted rams.
Figure 4:
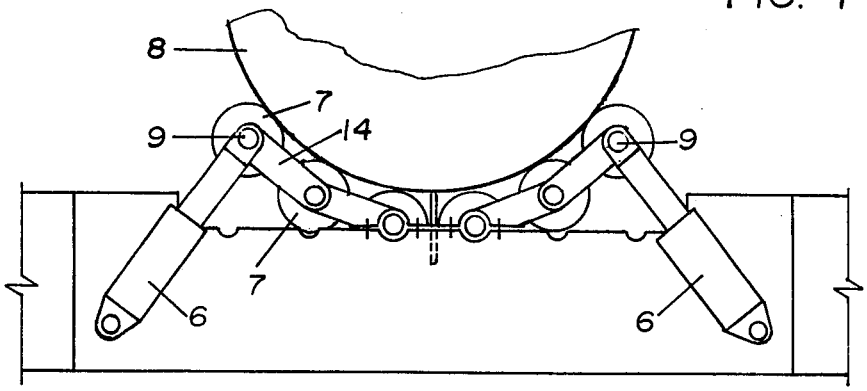
FIG. 4 is an elevation of the tire coupling device and its extended rams.
Figure 5:
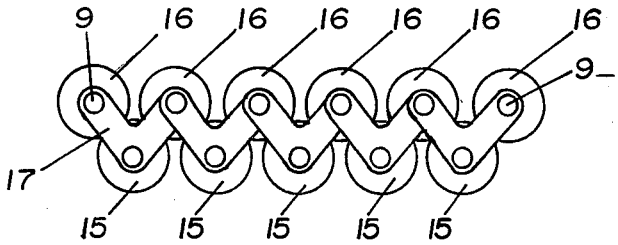
FIG. 5 is a section of the line V—V of FIG. 2 with retracted rams.
Figure 6:
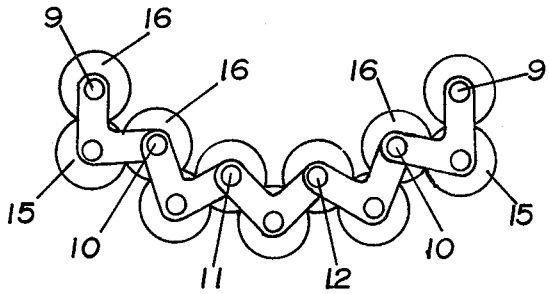
FIG. 6 is the same section of the line V—V of FIG. 2 with extended rams.
Figure 7:
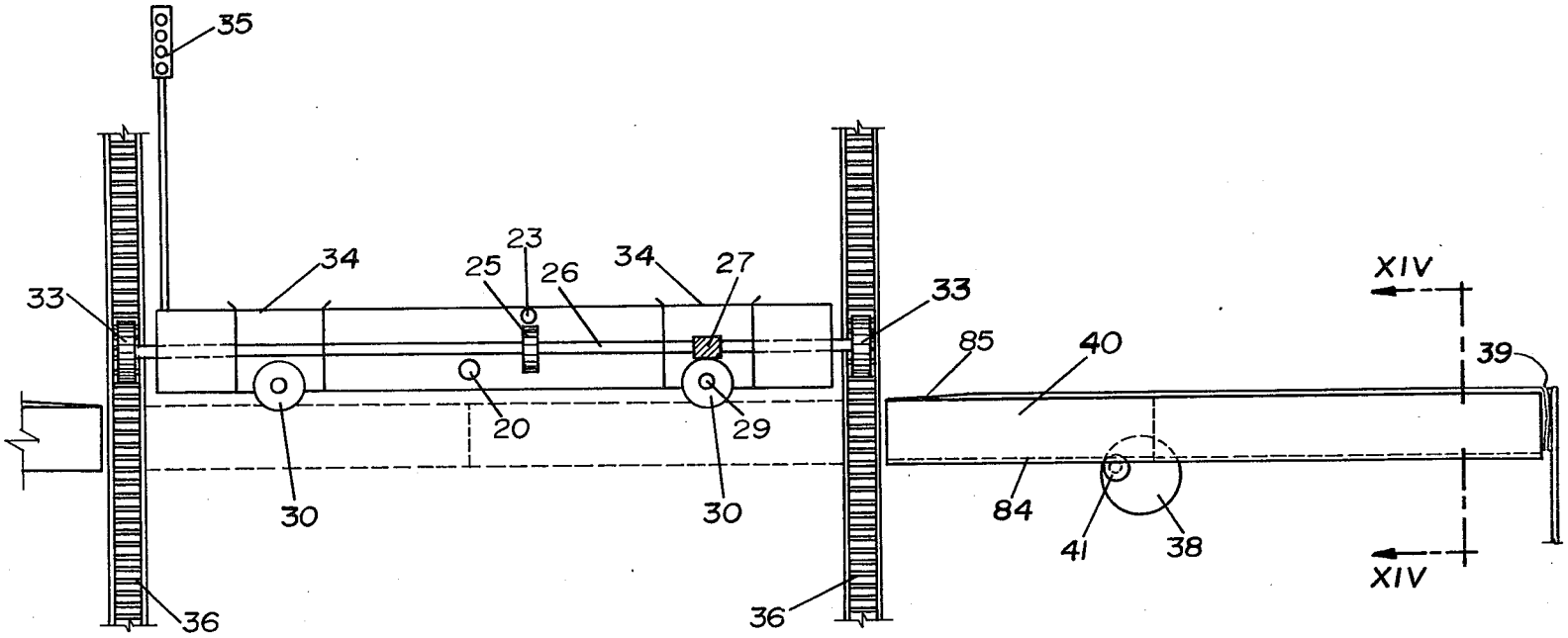
FIG. 7 is a section of the line VII—VII of FIG. 1 when the carrier is reaching its parking level in the structure.
Figure 9:
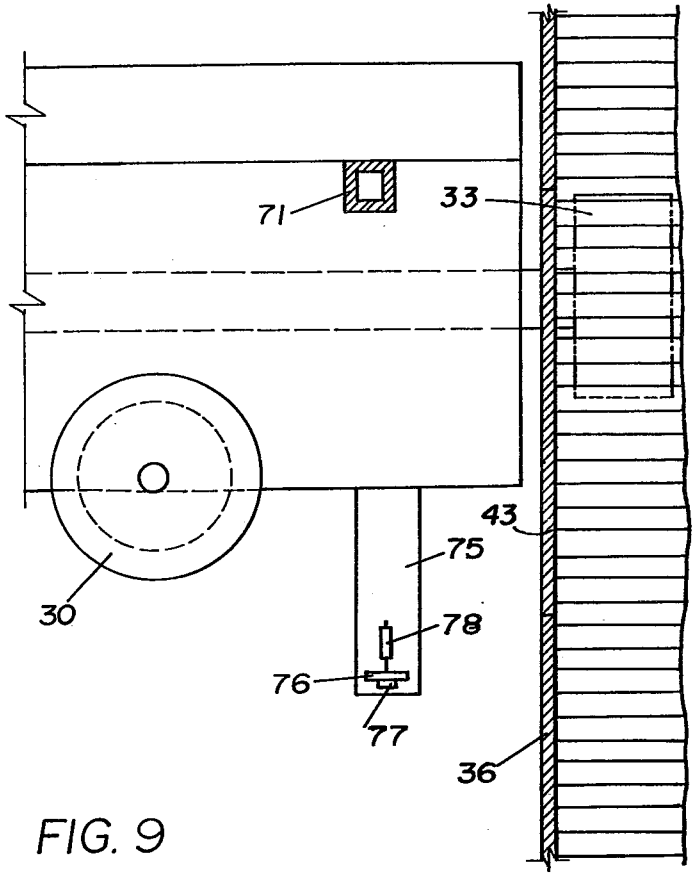
FIG. 9 is a section IX—IX of FIG. 8.
Figure 8:
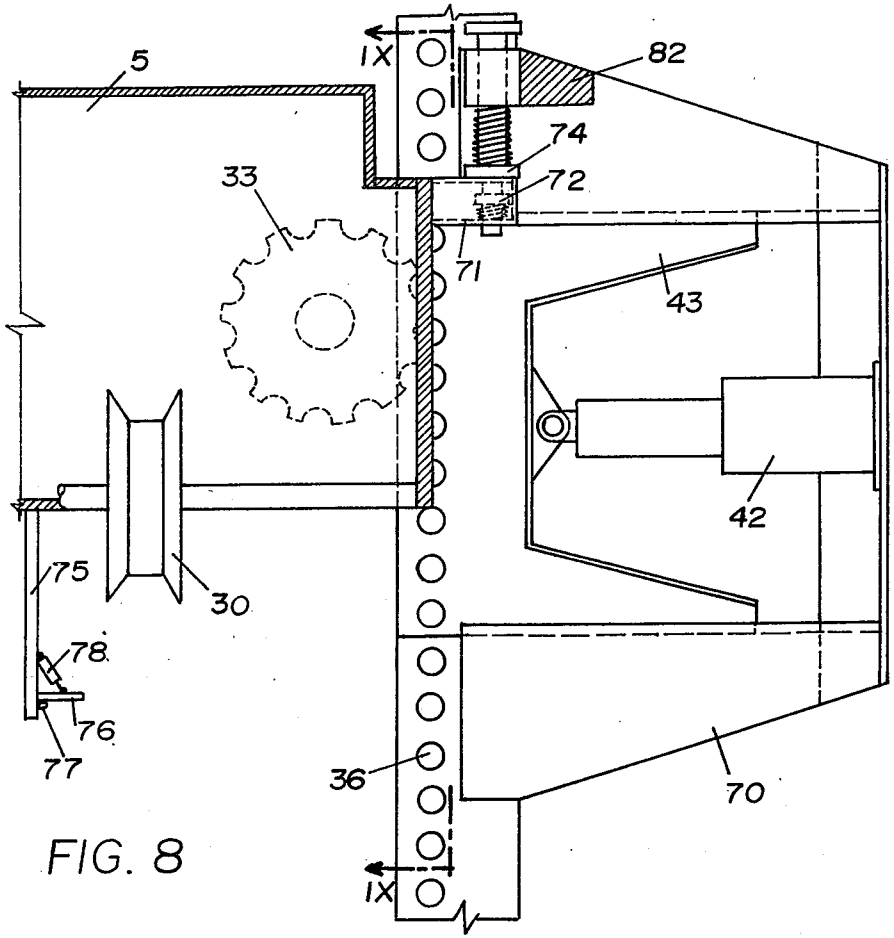
FIG. 8 is a partial section of the end of the carrier when it reaches its parking level and is stopped by the shock-absorbing switch.
Figure 11:
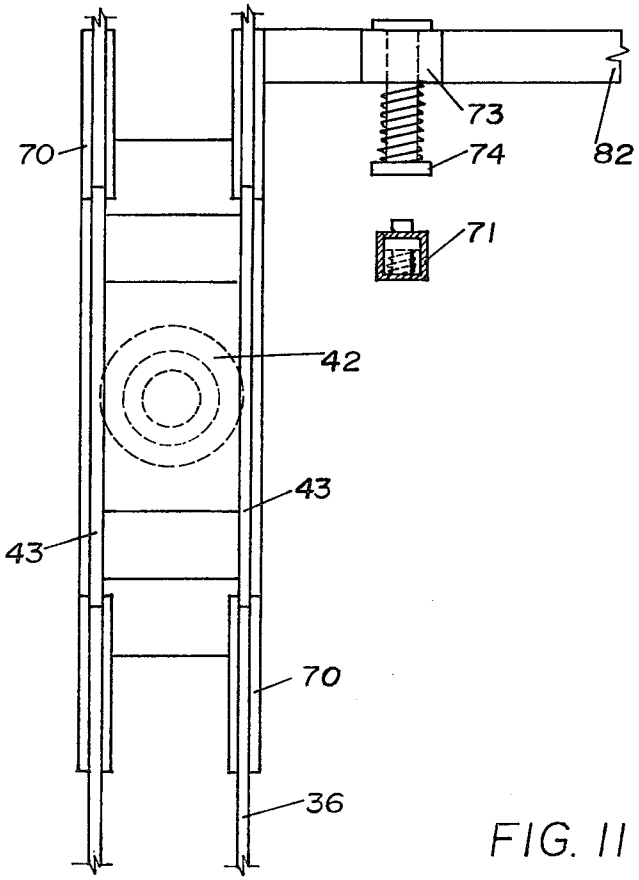
FIG. 11 is a section XI—XI of FIG. 10.
Figure 10:
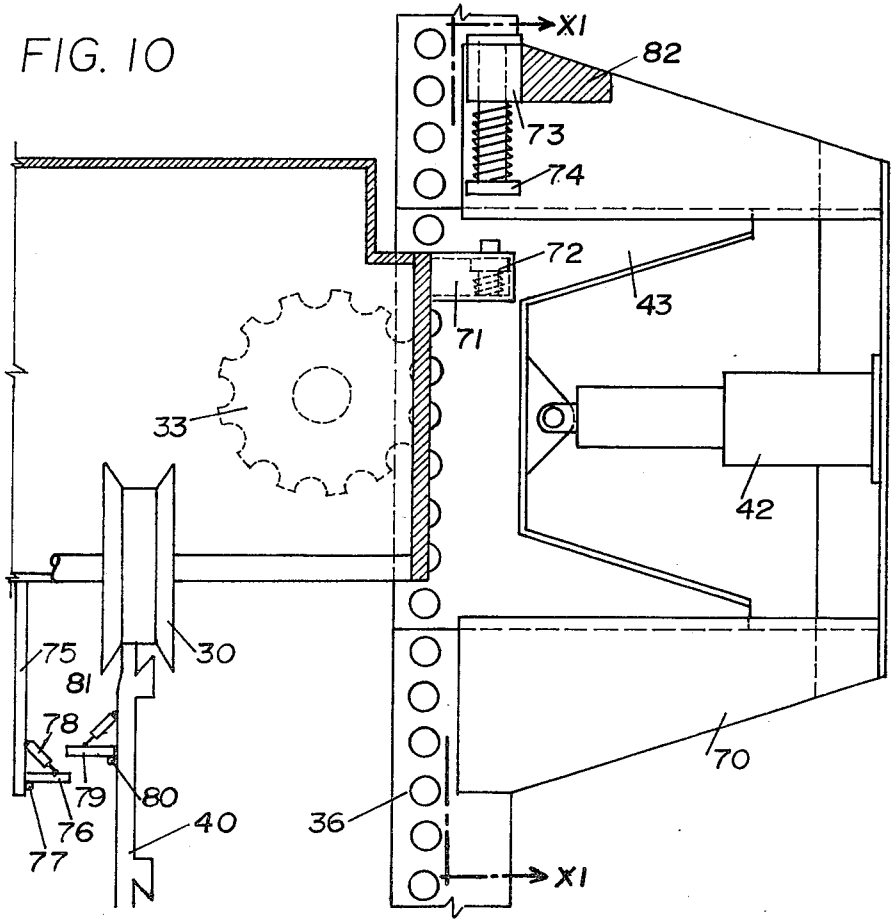
FIG. 10 is a partial section of the end of the carrier when it is lowering on the extensible rails.
Figure 13:
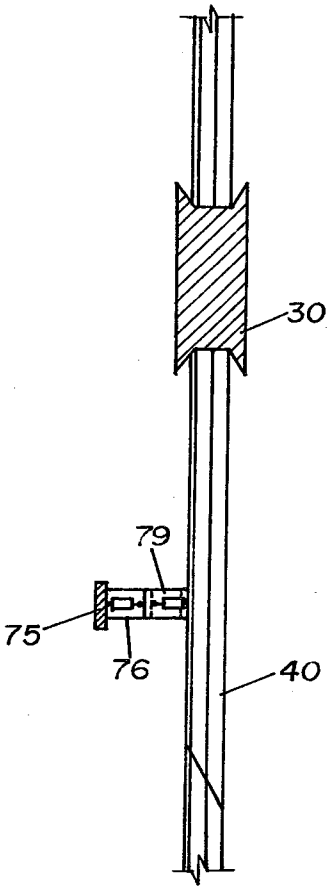
FIG. 13 is a section XIII—XIII of FIG. 12.

The system comprises a supporting structure of steel FIG. 20, 21, 22, 23 with a central zone 1, two lateral parts 2 and a basement 3. The central zone 1 is for vertical movement of carriers carrying the cars, the lateral parts 2 have a plurality of parking shelves disposed horizontally and vertically along the central zone, while the basement is for depositing the carriers in their rest position or mobile tracks when the carriers rest in their parking shelves. The carriers 5 take over cars from the ground and carry them by vertical and horizontal movements into the parking shelves. Each vehicle 5 has its own shelf. The cars are driven following the tracks 34 of carrier 5. When the propelling wheels of car 8 stop over the friction coated rollers 7 and at the same time over switch 69 an appointed number of seconds, switch 69 activates rams 6 and rollers 7 rise settling in order around the lower part of the propelling wheels of the car, so that the latter are able to involve the movement or stopping of the former. The friction coated rollers 7 are secured to shafts 9, 10, 11 and 12. Straps 13 bind axles 11 and 12 to the vehicle frame. Intermediate axles 10 are situated between axles 11, 12 and axles 9, the latter being in connection with rams 6. Pinions 16 are secured to shafts 9, 10, 11 and 12 while the idler pinions 15 mesh with the former so that all of them roll or stop together. Shaft 12 is a propelling shaft which conveys the power and the circular motion from the propelling wheels of the car to worm 18 and consequently to wormgear 18 and shaft 20. Pinions 21 secured to shaft 20 mesh with the pinions 22 secured to shafts 23. Worms 24 mesh with wormgears 25 secured to shafts 26. Pinions 33 are secured to shafts 26, and they mesh with vertical toothed racks 36 to perform the vertical movement. Worms 27 secured to shafts 26 mesh with wormgears 28 which are secured to shafts 29. Rollers 30 secured to shafts 29 perform the horizontal movement rolling on extensible rails 40 and fixed rails 39. Shaft 20 passes through brake 31 which is activated by compressed air. Each carrier is provided with two receptacles of compressed air which, when the platform is parked, are supplied through known means from the fixed compressed air system of the structure.

Figure 12:
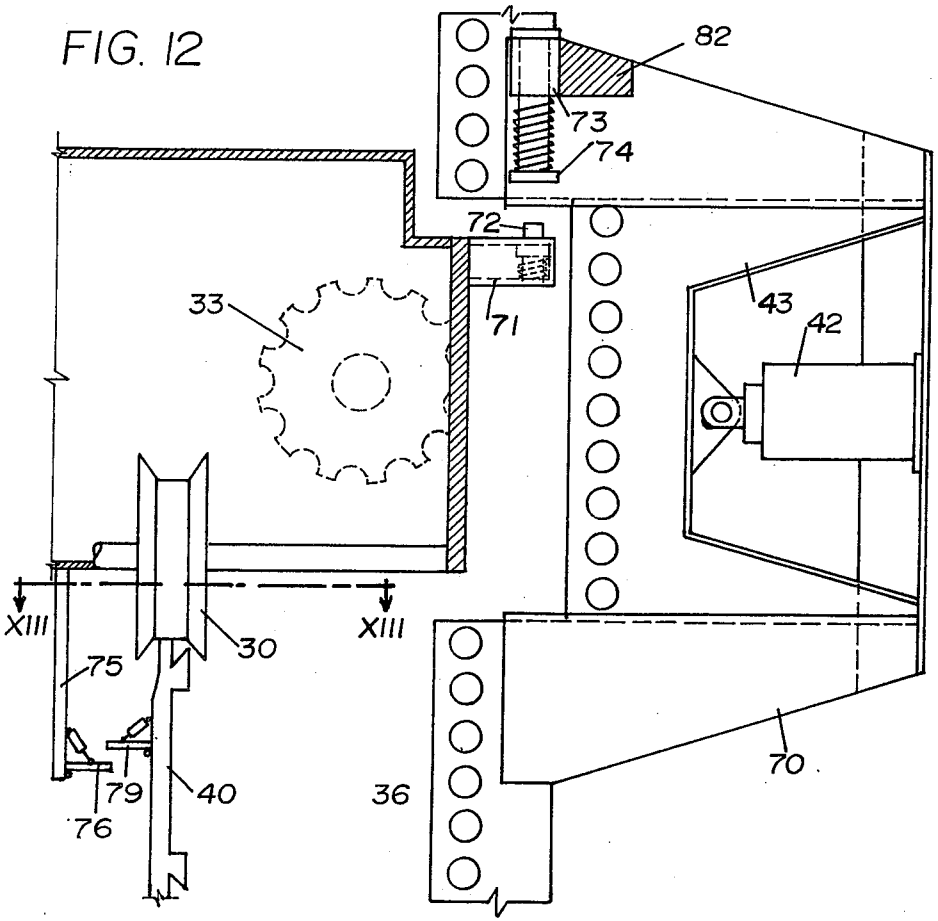
FIG. 12 is a partial section of the end of the carrier when the mobile segments of the racks are pulled.
Figure 14:
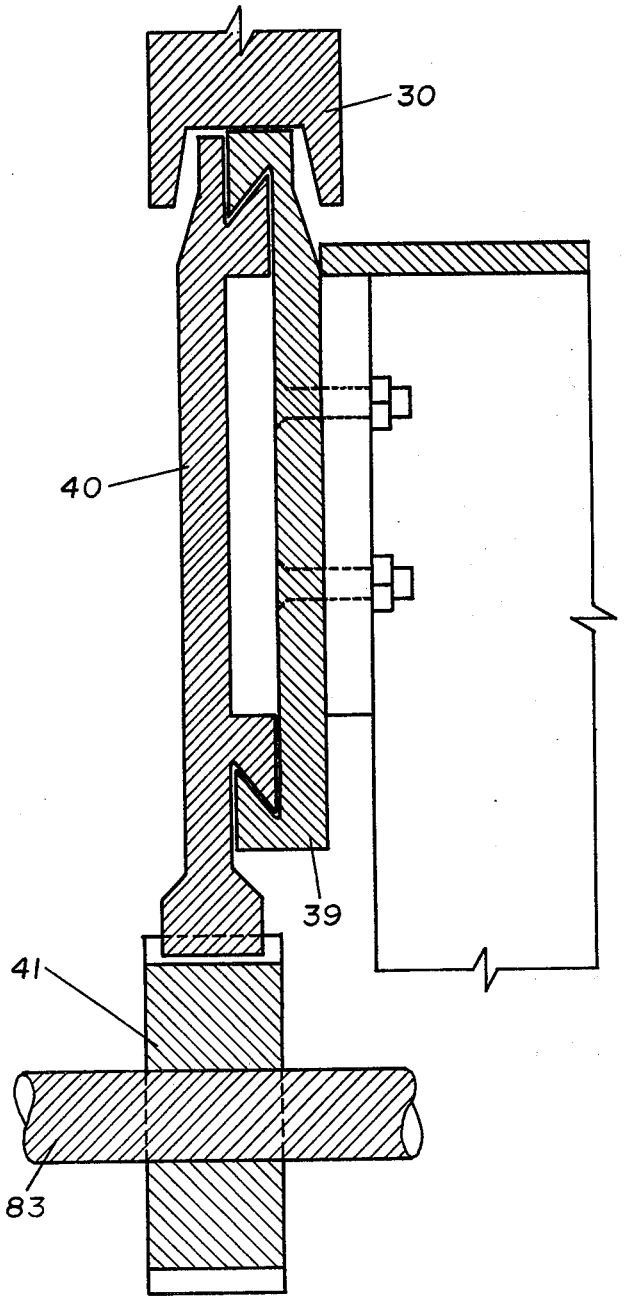
FIG. 14 is a section of the line XIV—XIV of FIG. 7.
Figure 15:
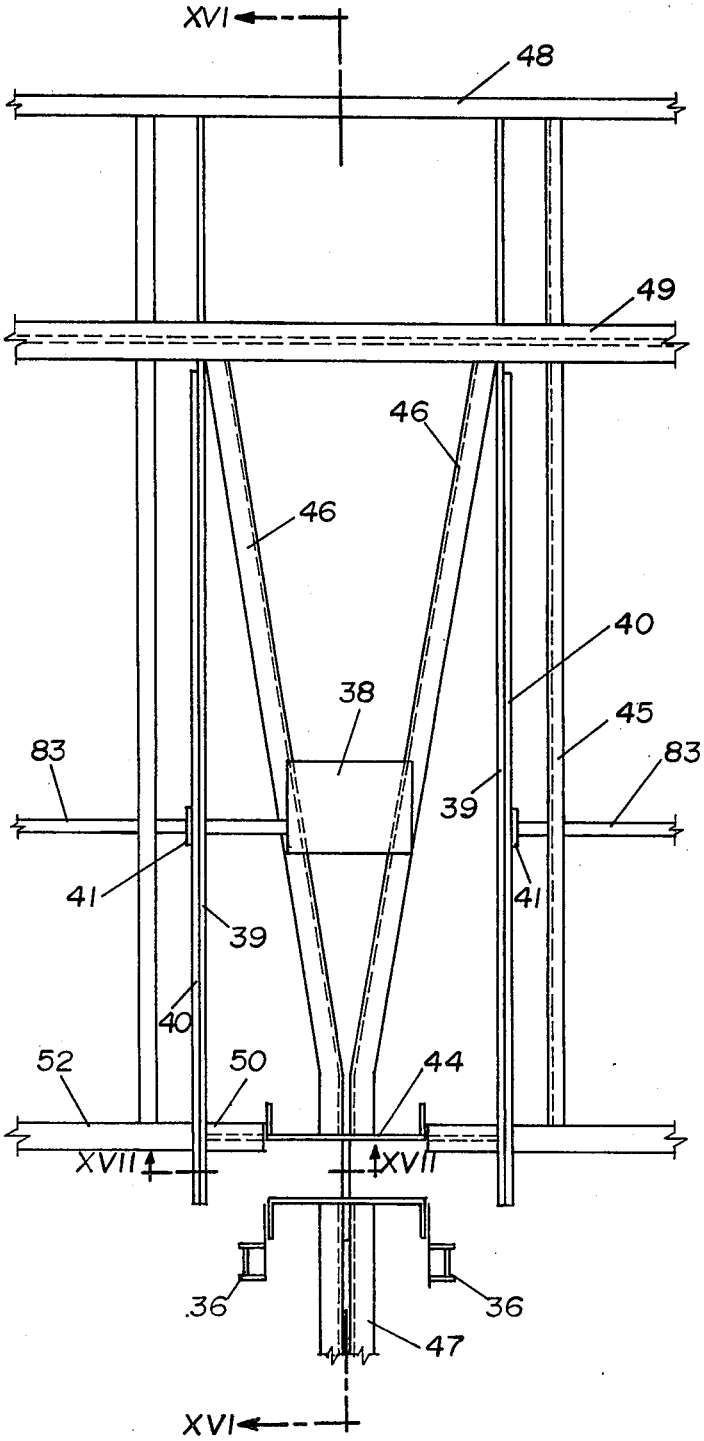
FIG. 15 is a section of a column with a plan view of the adjacent shelves.
Figure 16:
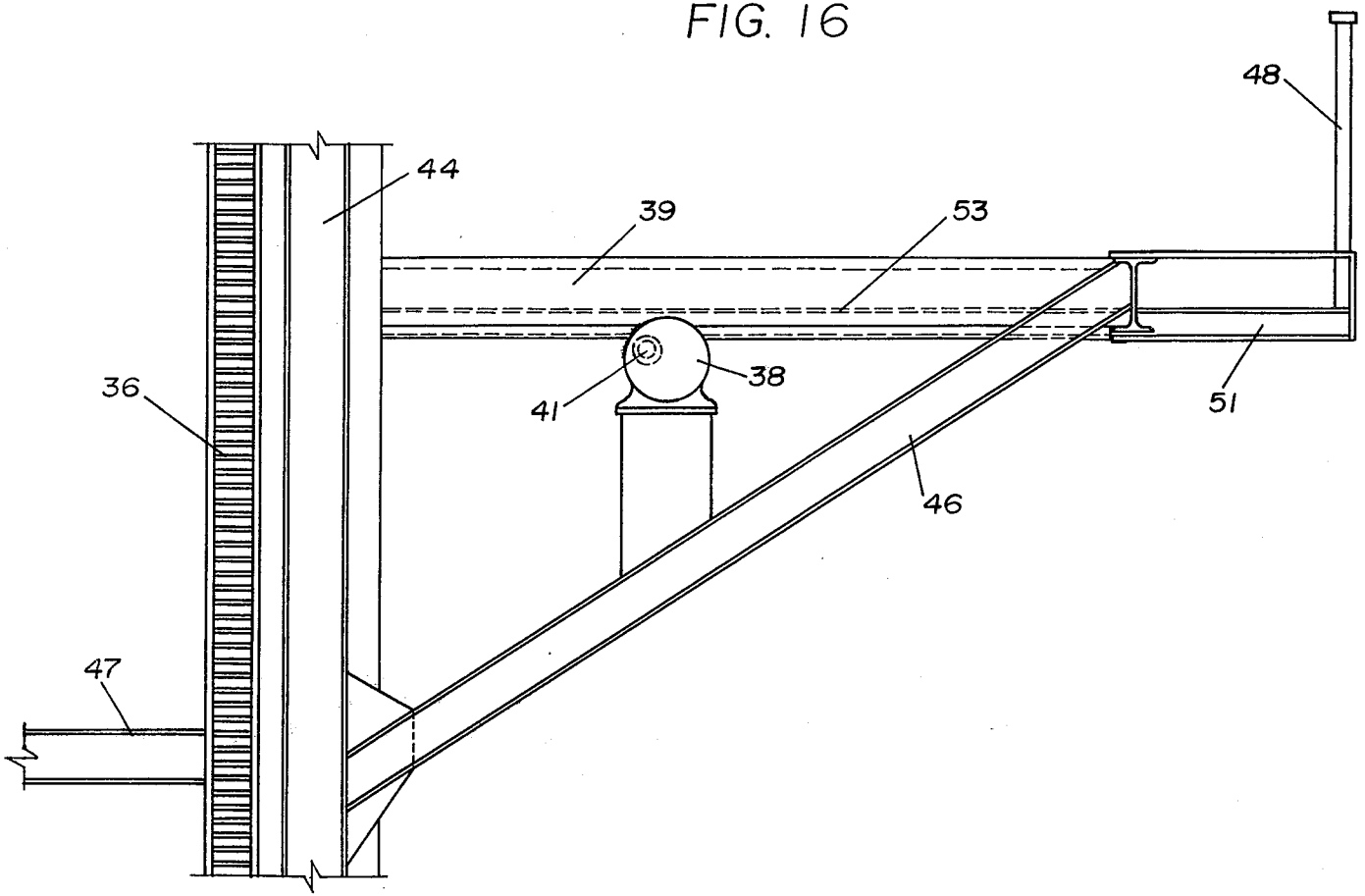
FIG. 16 is a section of the line XVI—XVI of FIG. 15.
Figure 17:
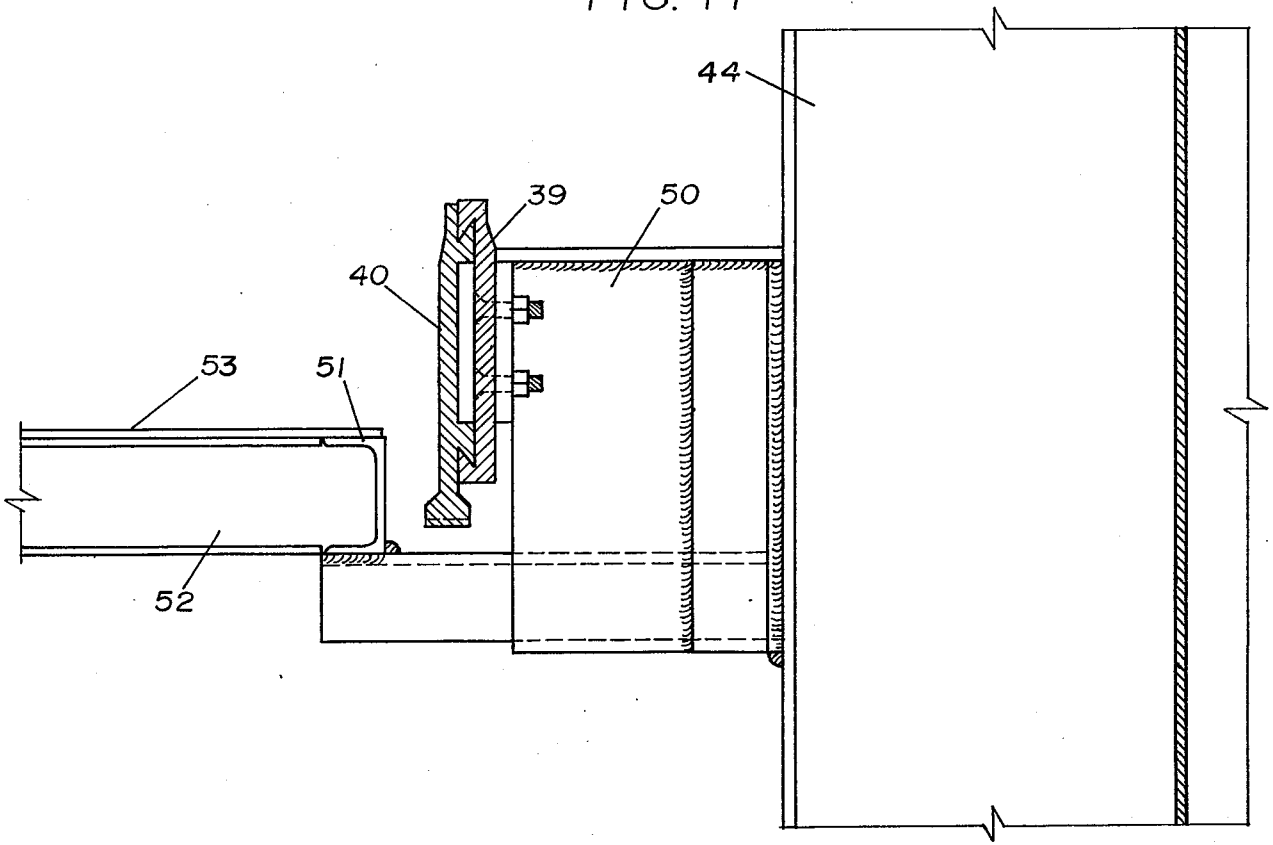
FIG. 17 is a section of the line XVII—XVII of FIG. 15.
Figure 18:
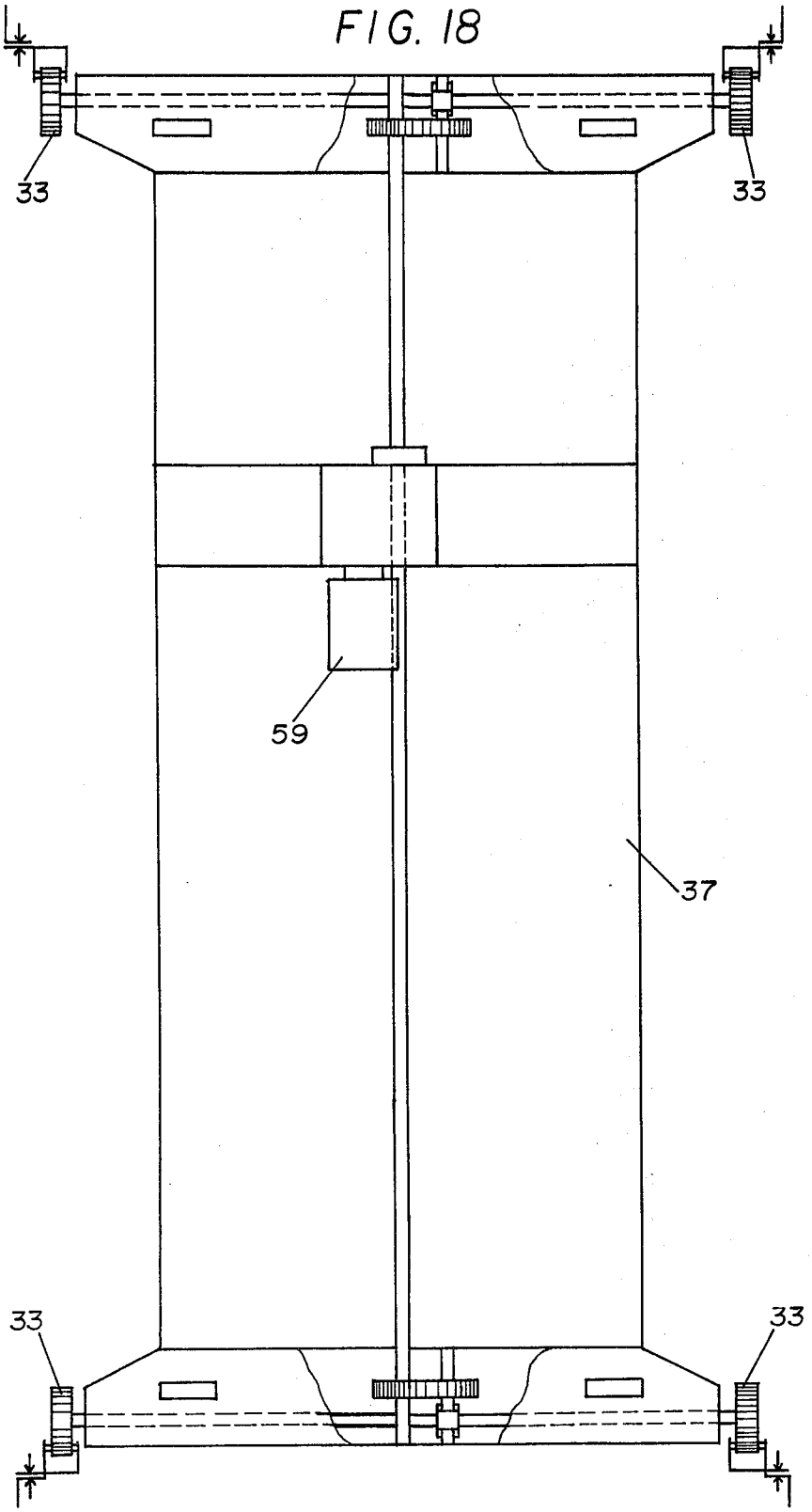
FIG. 18 is a top plan view of the bottom carrier of the basement.
Figure 19:
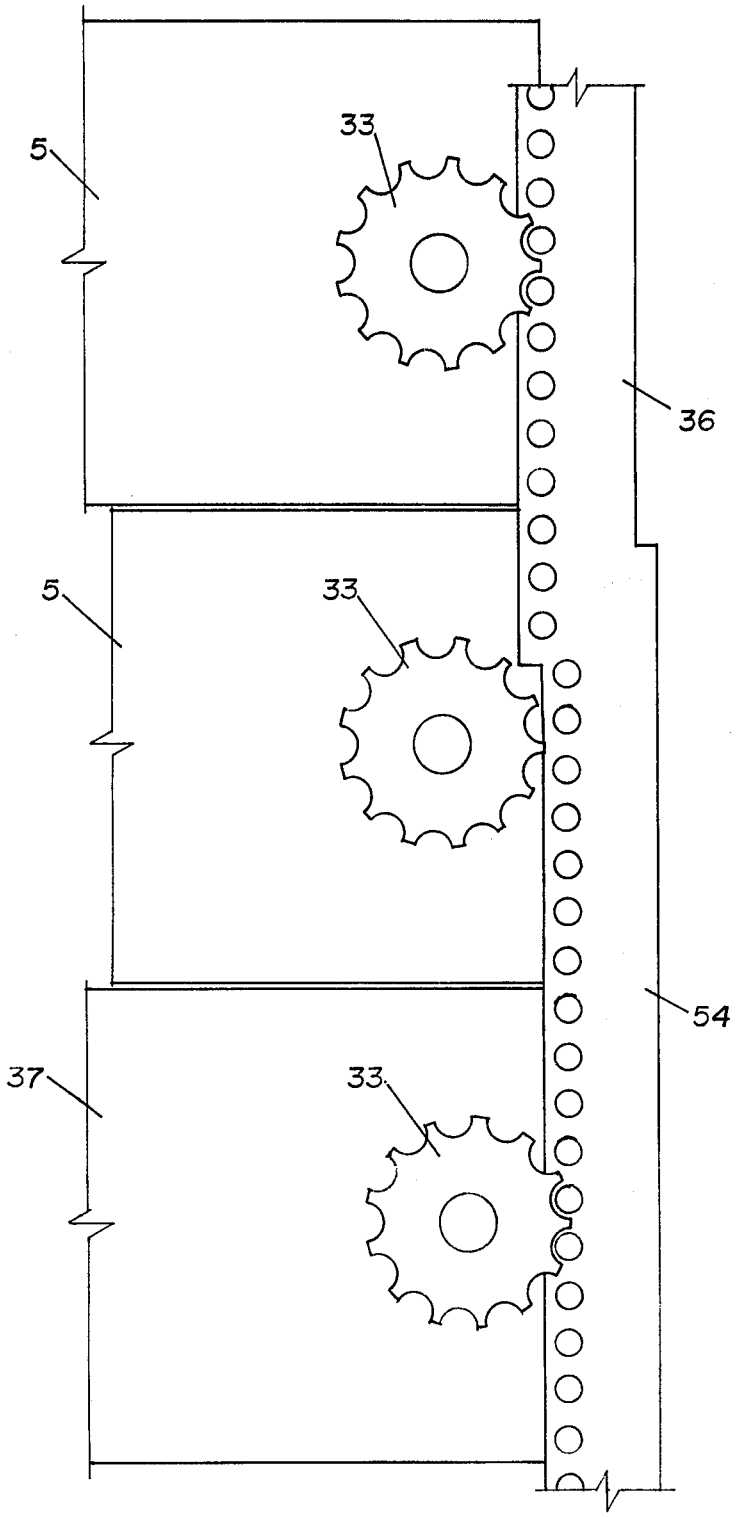
FIG. 19 is a section through the vertical racks when the bottom carrier supports two common carriers in the basement.
Figure 20:
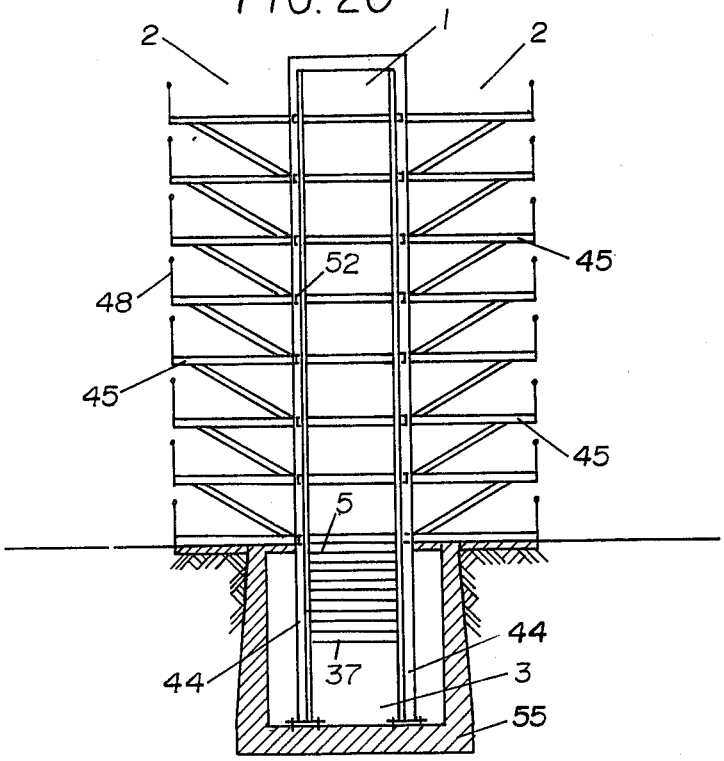
FIG. 20 is a cross section through the structure and its basement.
Figure 21:
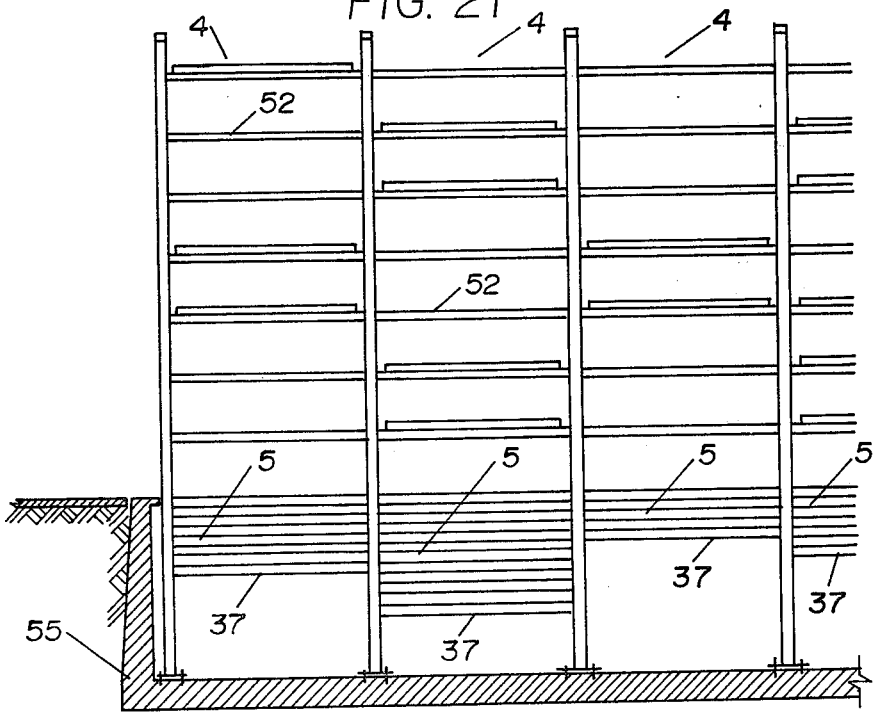
FIG. 21 is a longitudinal section through the structure and its basement.
Figure 24:
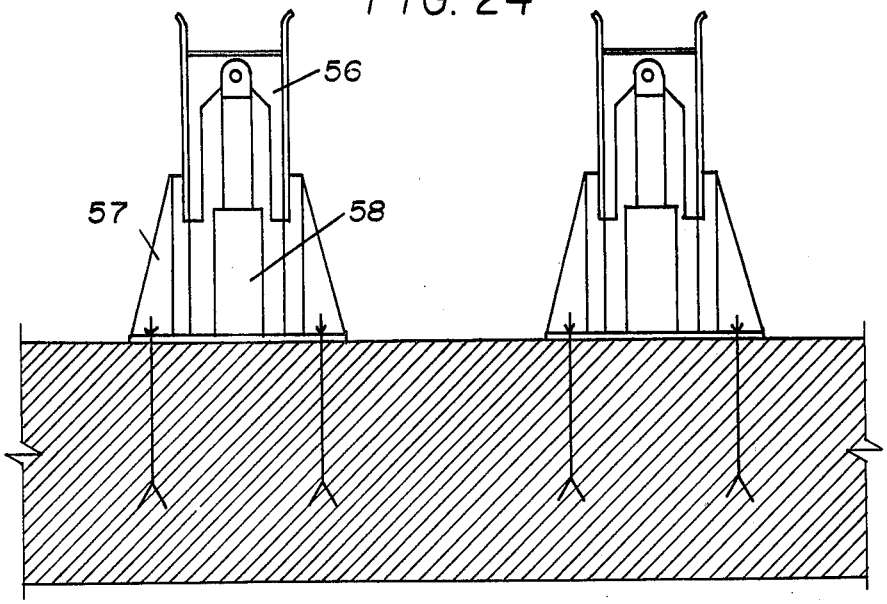
FIG. 24 is a cross section through a mobile track with its extended rams.
Figure 25:
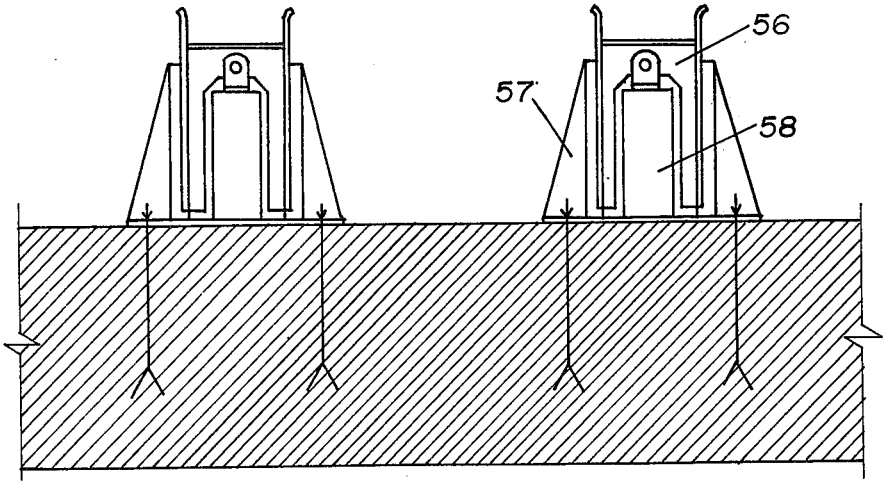
FIG. 25 is a cross section through a mobile track with its retracted rams.
Figure 26:
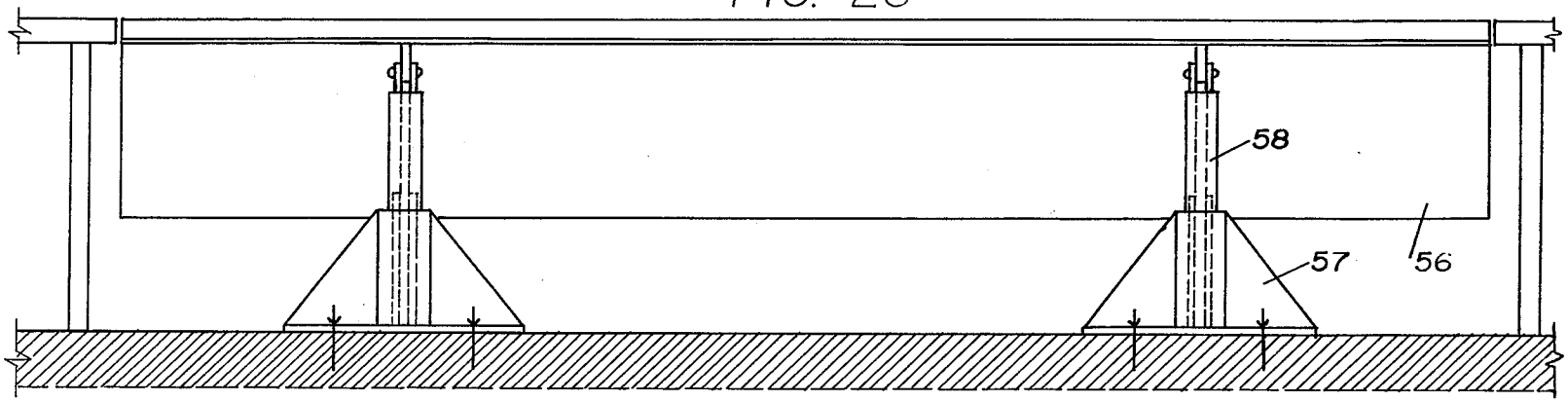
FIG. 26 is a longitudinal section through a mobile track with its extended rams.
Figure 27:
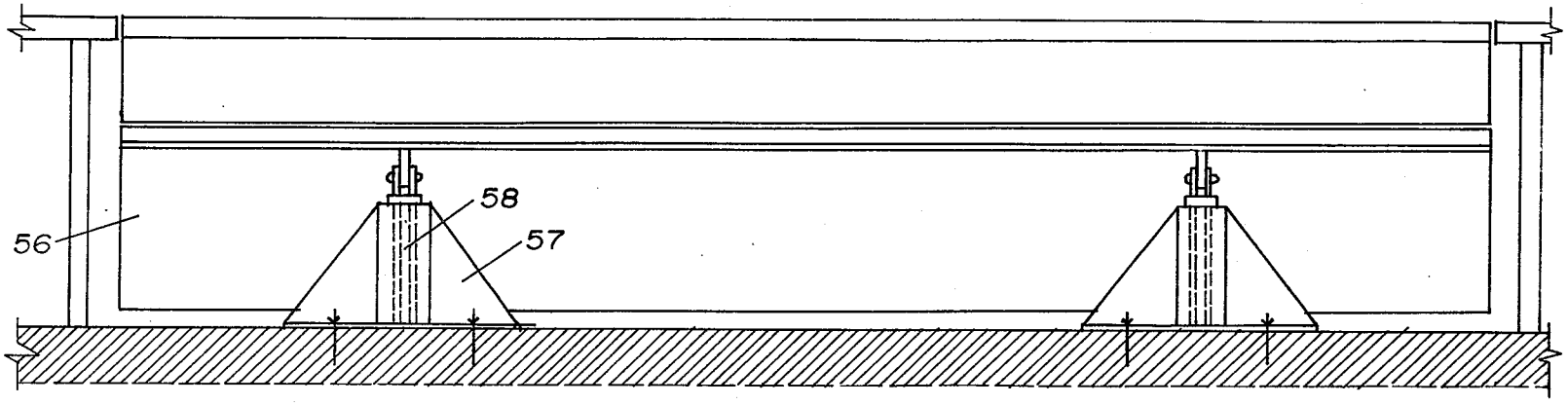
FIG. 27 is a longitudinal section through a mobile track with its retracted rams.

Taking the above into consideration, the parking system could be better illustrated by following a car from entrance to exit. The entering car on tracks 34 activates switch 69 first with the front wheels and then with propelling wheels 8. Switch 69 operates a light signal set up on side post 35. When switch 69 is pressed it starts a known clock mechanism which works only when its starter is pressed and returns at zero when its starter is free. This clock mechanism being pressed an appointed number of seconds activates rams 6 which extend joining rollers 7 with the propelling wheels of the car and at the same time brake 31 releases. The propelling wheels of the car are driving means for rotating shafts 12, 20, 26 and 29 by the driving gear means of the pinions, worms and wormgears as above mentioned. The forward motion of the propelling wheels activates finally pinions 33 and the carrier carrying the car raise on vertical racks 36. At about three feet from the ground, the raising carrier operates by known means a switch which commands the raising of the bottom carrier 37 with a carrier thickness so called a step. When the raising carrier reachs its parking level, arm 71 with switch 72 of the carrier knocks against arm 73 with shock-absorbing switch 74. Arm 73 is fixed to crossbeam 82 between vertical racks 36 in a proper position for each level corresponding to arms 71 of the carriers of the same level. The hoisting motion stops. Switch 72 signals to the driver to stop. Switch 74 activates electric motors 38 which rotate shafts 83 and its secured pinions 41 meshing with racks 84 of four rails 40 which extend on both sides from the shelves meshing beneath rollers 30. When the rails 40 are extended switch 74 commands their retraction. When rails 40 make contact between them in the middle of the central zone, a switch signals to the driver to being reverse driving of the car. When the car lowers, rollers 30 settle on rails 40, and arm 79 activated by arm 76 commands rams 42 which pull segments 43. Therefore vertical racks 36 become discontinued as in FIG. 12. The movement of segments 43 signals to the driver the forward motion, and rollers 30 roll on extensible rails 40 to the parking shelf of the carrier over fixed lines 39. Rail 39 has a small slope 85, rollers 30 rise from lower rail 40 to a higher position so that when the parking shelf is reached a switch activates the movement of extensible rail 40 beneath rollers 30. The driver gear means of rollers 30 are abvious antisymmetrical for two carriers which have to reach the opposite sides of the same level. Arms 76 and 79 are disposed by means of hinges 77 and 80 and springs 78 and 81 respectively on bracket 75 of the carrier and on rail 40 so that switch 79 activates only when it is knocked by arm 76 in its lowering motion. When extensible rails 40 are retracted in their shelves, a switch activates rams 42 to move segments 43 and to restore the continuity of the vertical racks. The exit of the carrier is achieved by opposite movements. The driver actuates a switch to extend rails 40 and to move segments 43. The finish of these movements signals the backward motion of the car. The carrier goes over rails 39 and 40 till it reaches the middle of the central zone, where a restrictive arm in a proper position, like arm 71 but not shown, stops the horizontal movement and commands the restoration of the vertical racks 36. The restoring signals to the driver an upward movement and now switch 74 commands the movement of extensible rails 40 in their shelves. Rails 40 activate a signal which points out the backward motion of the car and consequently the lowering of the carrier on racks 36. When the carrier approches the ground level, a switch commands a downward movement step of bottom carrier 37. When the carrier carrying the car reachs the ground a switch commands rams 6 and brake 31. Therefore the rollers 7 lower and their shafts become fixed. This step signals to the driver that the way is free to leave the parking structure. In order to guard the moving carriers from collision, known signals and blocking devices are set up. When a carrier is moving within a division 4, another car is stopped to enter the division, and any other carrier of the same division cannot be started. Basement 3 is high enough to take in the carriers of a division 4 all in one stack. The supporting structure is metallic and may be dismountable being composed by: columns 44, cantilevers 45, 50, braces 46, beams 47, 49, 51 and 52, and handrails 48. A metal plate 53 is set over beams 51 and 52 to protect the cars and drivers against the oil leakage. Bottom carrier 37 is a little longer than regular carriers 5, raising and lowering in the basement on vertical racks 54 which are disposed wider than racks 36, so that pinions 33 of the regular carriers do not mesh with vertical racks 54. The driving means of bottom carrier 37 is electric motor 59 fed by a flexible cable. Bottom carrier 37 raises a step after the departure of a carrier 5 from the stack, and lowers a step before the arriving of a carrier 5.

In the second example, unloaded carriers 5 rest in their shelves as in FIG. 22 and FIG. 23. On the ground, the cars move on mobile tracks 56. Mobile tracks 56 slide on guide bars 57 being up or down as rams 58 are extended or retracted. When a carrier 5 lowers to the ground, mobile tracks 56 lower to make room for carrier 5, and when carrier 5 leaves the ground, mobile tracks 56 raise to restore the path of the ground. The movements of carriers 5 are the same as in the first example, the driving means being not the propelling wheels of the car but electric motor 59 of vehicle 5. Electric motor 59 is fed by batteries 60 which are charged by known contact means in parking shelves. The switch which in the first example commands to the driver the forward or backward movements of the car, in the second example its commands these movements to electric motor 59 which is dimensioned to move a loaded carrier.

In the third example motor 59 is dimensioned to move an unloaded carrier. As a result the unloaded carriers are moved by their proper electric motors 59, and the loaded carriers are moved by the propelling wheels of the cars which are carried.

Figure 28:
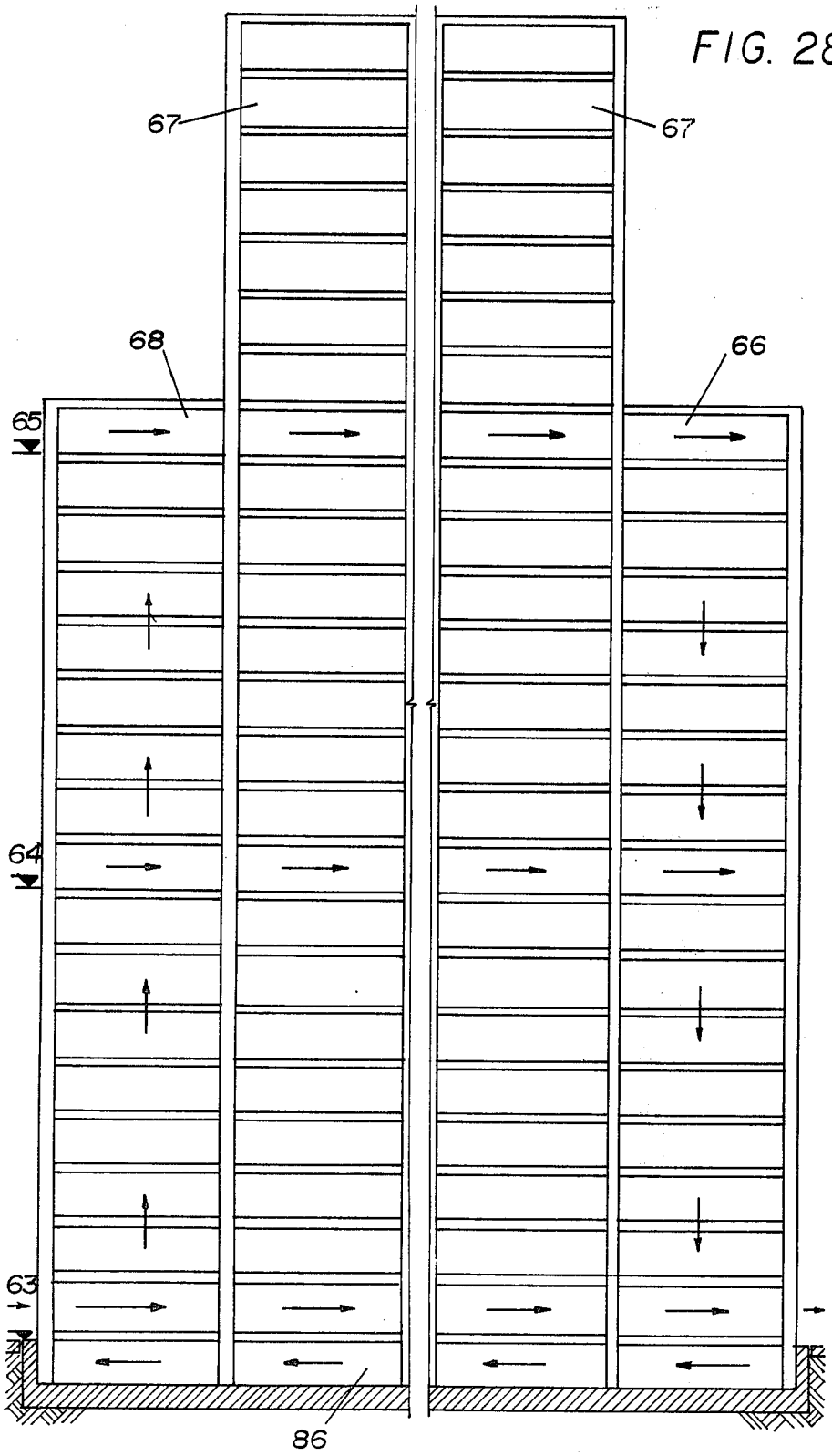
FIG. 28 is a longitudinal section through a pile of superimposed units.
Figure 29:
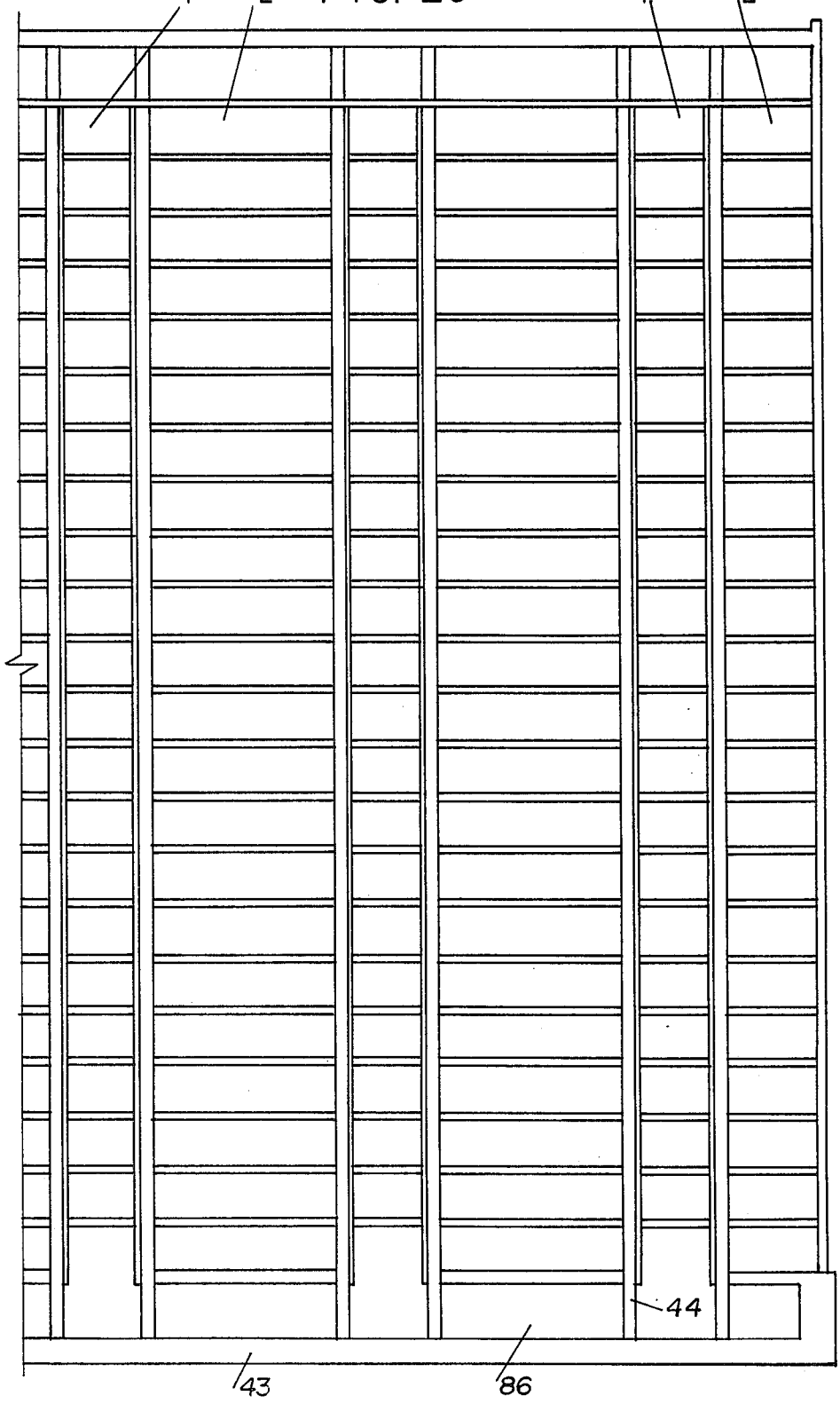
FIG. 29 is a cross section through a pile of juxtaposed stacks of parking units.

In another example the parking shelves disposed horizontally and vertically on the entire length and height of a central zone of vertical movement 1 form a unit. A plurality of units are superimposed forming a stack of units, and a plurality of stacks are juxtaposed forming a parking block. Inside a unit the movements are accomplished with electric motor 59 and the movement between units is carried out by known means as high speed elevators set on two ends of each stack, one being the entrance and other the exit. In this example the carriers leave their own division 4 and move along the unit on an entrance-exit path as 63, 64 or 65. As an example in FIG. 28 and 29 there are three superimposed units. At the ground each stack of units has a main entrance-exit path 63. Each end of these entrance-exit paths is provided with elevator shafts 66, 68. In the elevator shafts 68 and 66, high speed elevators raise and lower respectively the carriers to and from their unit's entrance-exit paths. The directions of movement are shown in FIG.

22 by arrows. The unloaded carriers return from exit to entrance along basement 86 of the parking block. The movement in such parking blocks is computerized.

Furthermore, the units can be used lengthwise along the roads near the curbs having the two lateral parts for parking at two different levels required by the circulation limit gauges. The units can be set along the road axis above ground or underground.

The embodiments of the invention in which an exclusive property or privilege is claimed are defined as follows:

1. A parking system for cars, comprising in combination a spatial structure having a plurality of parking shelves disposed horizontally and vertically on both sides of a central zone of vertical movement; an entrance-exit path at the ground in said central zone of vertical movement; a central basement beneath said entrance-exit path; two pairs of vertical racks, each rack extending in the corners of each well formed by a pair of carriers tiers of said parking shelves; a plurality of vehicles each for supporting one car and carrying it from said entrance-exit path vertically and horizontally to appointed said parking shelves and vice versa; a pair of horizontal extensible rails in each of said parking shelves, the extensible parts of said extensible rails on both sides at the same level extending into the central zone when said carrier has arrived at its parking level or when said carrier leaves its said parking shelf; a coupling device having a plurality of friction coated rollers connected in pairs by shafts and arranged on a platform of said vehicle for meshing with the pair of propelling wheels of a car; a switch between said friction coated rollers for starting a clock mechanism when said switch is pressed by a wheel of the car; said clock mechanism working only when its starter is pressed and returning at zero when its starter is free; said clock mechanism activating ram means after an appointed number of seconds of working; said ram means when activated push up said friction coated rollers which raise settling around the propelling wheels of the car making a couple with them; four pinions connected in pairs by shafts at each end of said carrier meshing each one with one of said vertical racks; four rollers provided in pairs at each end of said carrier for its movement on said horizontal extensible rails; a first driving gear means on said carrier for rotating simultaneously said four pinions and said four rollers performing subsequently the vertical and horizontal movement of said carrier; driving means and a second driving gear means in said parking shelves for moving the said horizontal extensible rails; a mobile rack on each of said vertical racks at each level of said parking shelves for performing a discontinuity on said vertical racks when said carrier has arrived at its parking level and said horizontal extensible rails are extended or when said carrier quitting said parking shelf moves towards central zone on said horizontal extensible rails to reach its said well for lowering to the ground, and for performing the continuity of said vertical racks when said carrier has reached its parking shelf and said horizontal extensible rails are retracted or when said carrier has reached its well from its parking shelf for lowering to the ground; a first series of pinions on said shafts of said coupling device meshing with a second series of idler pinions arranged in the interval of said first series of pinions one of them meshing with a third driving gear means for connecting said shafts of said coupling device with said first driving gear means; a brake mounted on said carrier connecting said third driving gear means for fixing said friction coated rollers when the car moves about on said platform of said carrier; one or two receptacles of compressed air on each of said carrier for activating said rams and said brake; said receptacles are fed from a fixed compressed air system of said spatial structure when said carrier is in its parking shelf; one or two batteries on each of said carrier for activating said switch, light signals and an electric motor when it is set on said carrier; said batteries are fed from a fixed equipment of said spatial structure when said carrier is in its parking shelf.

2. A parking system for cars as defined in claim 1, in which said carriers in their rest position are superimposed in said central basement over a bottom carrier; said bottom carrier ascending a step after the departure of one of said carrier and descending a step when one of said carrier is arriving, a step being the height of said carrier; two pairs of vertical racks in basement having bigger limit gauge than said vertical racks in said wells and meshing only with the said four pinions of said bottom carrier, said four pinions of said carriers being disengaged in said central basement; the uppermost of superimposed carriers in said central basement make up at the ground level said entrance-exit path; said propelling wheels of car are driving means for rotating said first and third driving gear means and consequently said four pinions and said four rollers of said carrier for accomplishing the vertical and horizontal movements of said carrier.

3. A parking system for cars as defined in claim 1, in which the rest positions of said carrier are in said parking shelves; said carrier has driving means for rotating said first and third driving gear means and consequently said four pinions and said four rollers of unloaded said carrier when it moves from said parking shelf to said entrance-exit path to get a car, or it moves from said entrance-exit path to said parking shelf after leaving a parked car; for each said well in said central basement is a mobile track having a low position when said mobile track makes room for a coming down said carrier, and a high position making up said entrance-exit path when all said carriers are in their shelves; the mobile track has four rams for performing the vertical movement of said mobile track; said propelling wheels of car are driving means for rotating said first and third gear means and consequently said four pinions and said four rollers of said carrier for accomplishing the vertical and horizontal movements of said carrier when it is loaded.

4. A parking system for cars as defined in claim 1, in which the rest positions of said carriers are in said parking shelves; said carrier has driving means for rotating said first and third driving gear means and consequently said four pinions and said four rollers of said carrier when it is either loaded or unloaded; for each said well in said central basement is a mobile track having a low position when said mobile track makes room for a coming down said carrier and a high position making up said entrance-exit path when said carriers are in their parking shelves; the mobile track has four rams for performing the vertical movement of said mobile track; said propelling wheels of car are in neutral when setting on said coupling device.

5. A parking system for cars as defined in claim 4, in which said shelves are doubled taking two said carriers; one of two said carriers is inside carrier being adjacent to said well, and the other one is outside carrier, said inside carrier getting out from its shelf and raising one level to give free way when said outside carrier is called to make its out and return movement.

6. A parking system for cars as defined in claim 4, in which said parking shelves disposed horizontally and vertically on the entire length and height of said central zone of vertical movement form a unit; a plurality of said units superimposed forms a stack of units; a plurality of said stack of units juxtaposed forms a parking block; each said unit has an entrance-exit path at its lowest level to allow the horizontal movement of carriers along the unit from entrance to exit; each said stack of units has a main entrance-exit path at the ground level, one said parking block having main entrance-exit paths as many as said stacks of said units; in front of each said central zone of vertical movement one shaft is equipped with one high speed elevator for raising loaded or unloaded said carriers from ground to said entrance-exit path of said units of said carriers, from where said carriers get their said parking shelves by their own means; behind each said central zone of vertical movement one shaft is equipped with one high speed elevator for lowering loaded or unloaded said carriers from said entrance-exit path of their units to the ground; beneath every said main entrance-exit path one tunnel is equipped with a conveyor to move unloaded said carriers from exit to entrance.

* * * * *